US007980881B2

(12) United States Patent
Furio et al.

(10) Patent No.: US 7,980,881 B2
(45) Date of Patent: Jul. 19, 2011

(54) CONNECTING DEVICE AND METHOD OF USE

(75) Inventors: Miguel Furio, Chaville (FR); Jeremy Dreux, Courdimanche (FR)

(73) Assignee: Tyco Electronics France SAS, Pontoise (FR)

( * ) Notice: Subject to any disclaimer, the term of this patent is extended or adjusted under 35 U.S.C. 154(b) by 0 days.

(21) Appl. No.: 12/523,354

(22) PCT Filed: Jan. 16, 2008

(86) PCT No.: PCT/IB2008/001711

§ 371 (c)(1),
(2), (4) Date: Jul. 16, 2009

(87) PCT Pub. No.: WO2008/117181

PCT Pub. Date: Oct. 2, 2008

(65) Prior Publication Data

US 2010/0112860 A1 May 6, 2010

(30) Foreign Application Priority Data

Jan. 17, 2007 (FR) ..... 07 52730

(51) Int. Cl.
*H01R 13/648* (2006.01)

(52) U.S. Cl. ..... 439/364; 439/607.5

(58) Field of Classification Search ..... 439/607.18, 439/364, 926, 565, 132

See application file for complete search history.

(56) References Cited

U.S. PATENT DOCUMENTS

| | | | | |
|---|---|---|---|---|
| 1,503,275 | A * | 7/1924 | McFaddin | 439/361 |
| 5,266,047 | A * | 11/1993 | Black et al. | 439/364 |
| 5,509,823 | A | 4/1996 | Harting | |
| 5,564,948 | A | 10/1996 | Harting | |
| 5,911,590 | A * | 6/1999 | Kodama et al. | 439/364 |
| 5,971,791 | A * | 10/1999 | Itoh et al. | 439/364 |
| 6,012,950 | A | 1/2000 | Vanbesien | |
| 6,530,801 | B2 * | 3/2003 | Bates et al. | 439/364 |
| 6,896,535 | B2 * | 5/2005 | Yamada et al. | 439/289 |

FOREIGN PATENT DOCUMENTS

| | | | |
|---|---|---|---|
| DE | 9218209 | U1 | 12/1993 |
| EP | 0090539 | A2 | 10/1983 |
| EP | 0957540 | A2 | 11/1999 |

OTHER PUBLICATIONS

International Publication No. WO 2008/117181 A3 published Oct. 2, 2008 with attached International Search Report dated Jan. 22, 2009 (International application No. PCT/IB2008/001711) (5 pages).

(Continued)

*Primary Examiner* — Michael C Zarroli
(74) *Attorney, Agent, or Firm* — Barley Snyder LLC

(57) ABSTRACT

The connecting device for connecting a cable fitted with a conductive shell to a case having a receiving portion, a contact portion, and a conductive joint. The contact portion includes electrical contacts, which are adapted to be joined with the receiving portion and with a printed circuit board. The conductive joint is crimped together with a shielding element of the case, between the receiving and contact portions, with the receiving portion allowing passage of the cable and fitted shell until it is located in abutment with the conductive joint.

11 Claims, 3 Drawing Sheets

OTHER PUBLICATIONS

International Preliminary Report on Patentability cited in co-pending International Application No. PCT/IB2008/001711, issued Jul. 21, 2009, 1 page.
Written Opinion cited in co-pending International Application No. PCT/IB2008/001711, issued Jul. 21, 2009, 6 pages.
French Preliminary Search Report cited in co-pending International Application No. FR0752730, issued on Sep. 6, 2007, 3 pages.
French Written Opinion cited in co-pending International Application No. FR0752730, issued on Sep. 6, 2007, 3 pages.

* cited by examiner

CONNECTING DEVICE AND METHOD OF USE

CROSS-REFERENCE TO RELATED APPLICATIONS

This application is a continuation of PCT International Application No. PCT/IB2008/001711, filed Jan. 16, 2008, which claims priority under 35 U.S.C. § 119 to French Patent Application No. 0752730, filed Jan. 17, 2007.

FIELD OF THE INVENTION

The invention relates to a connecting device and process of connecting cables to printed circuit boards that are enclosed within a case.

BACKGROUND

In order to connect a cable to a printed circuit board, it is well known to join a receptacle to the printed circuit board, while also joining a plug to the cable. When the receptacle and the plug are configured to be joined together, for example, using a thread or a bayonet system, they each include an internal electrical connector to transfer the signals carried by the cable. The cable is fitted with an external shield, or shell, and the printed circuit is integrated into a case, usually metallic, to protect the signals from electrical interference. In order to ensure continuity of the shielding, between the cable shielding and the case protecting the printed circuit via the plug and the receptacle comprising several parts, the contact points have to be multiplied. This complicates the geometry of the parts and increases their cost.

When a shielded connector must also have a keying mechanism to prevent incorrect positioning of the cable connector, several problems arise. In effect, it is difficult to make a peripheral shielding element, fitted with contacts allowing continuity of the shielding, compatible with the connector's keying requirement for the following reasons. To achieve mechanically efficient keying, it is preferable for the forms opposite a coupling in an undesirable position to be located as close as possible to the periphery of the connecting interface. Additionally, where a case is likely to receive a large number of similar connectors, it is preferable to obtain a sufficient number of keying combinations. When the connectors are small, it becomes necessary to use a large part or the entirety of the connector interface cover in order to dispose the keying forms. Furthermore, the areas allowing the keying must not impair the efficiency of the shielding. Consequently, the peripheral shielding element must adopt these forms, which means that the shielding device must be modified to each version, which increases cost. The position and the form of the multiple resilient contacts also become problematic, given the presence and variable position of the keying elements.

One known solution consists in moving an area containing the keying mechanism inside the shielded area. The disadvantage of this solution is that it increases both the space needed and overall weight, while reducing the mechanical efficiency of the keying mechanism due to the leverage.

The above-mentioned problems are further augmented in a case where the connection must be watertight, considering the additional constraints on the space needed and the forms provided by the seal.

SUMMARY

In view of these drawbacks, it is an object of the invention, among other objects, to provide a connecting device for connecting a cable fitted with a conductive shell to a case having a receiving portion, a contact portion, and a conductive joint. The contact portion includes electrical contacts, which are adapted to be joined with the receiving portion and with a printed circuit board. The conductive joint is crimped together with a shielding element of the case, between the receiving and contact portions, with the receiving portion allowing passage of the cable and fitted shell until it is located in abutment with the conductive joint.

As a result of these provisions, simply pressing the conductive shell onto the conducting layer ensures continuity of the shielding. Furthermore, the implementation of the present invention allows reduced manufacturing costs.

BRIEF DESCRIPTION OF THE DRAWINGS

The invention will be described in detail with reference to the following figures of which.

DETAILED DESCRIPTION OF THE EMBODIMENT(S)

Figure 1:
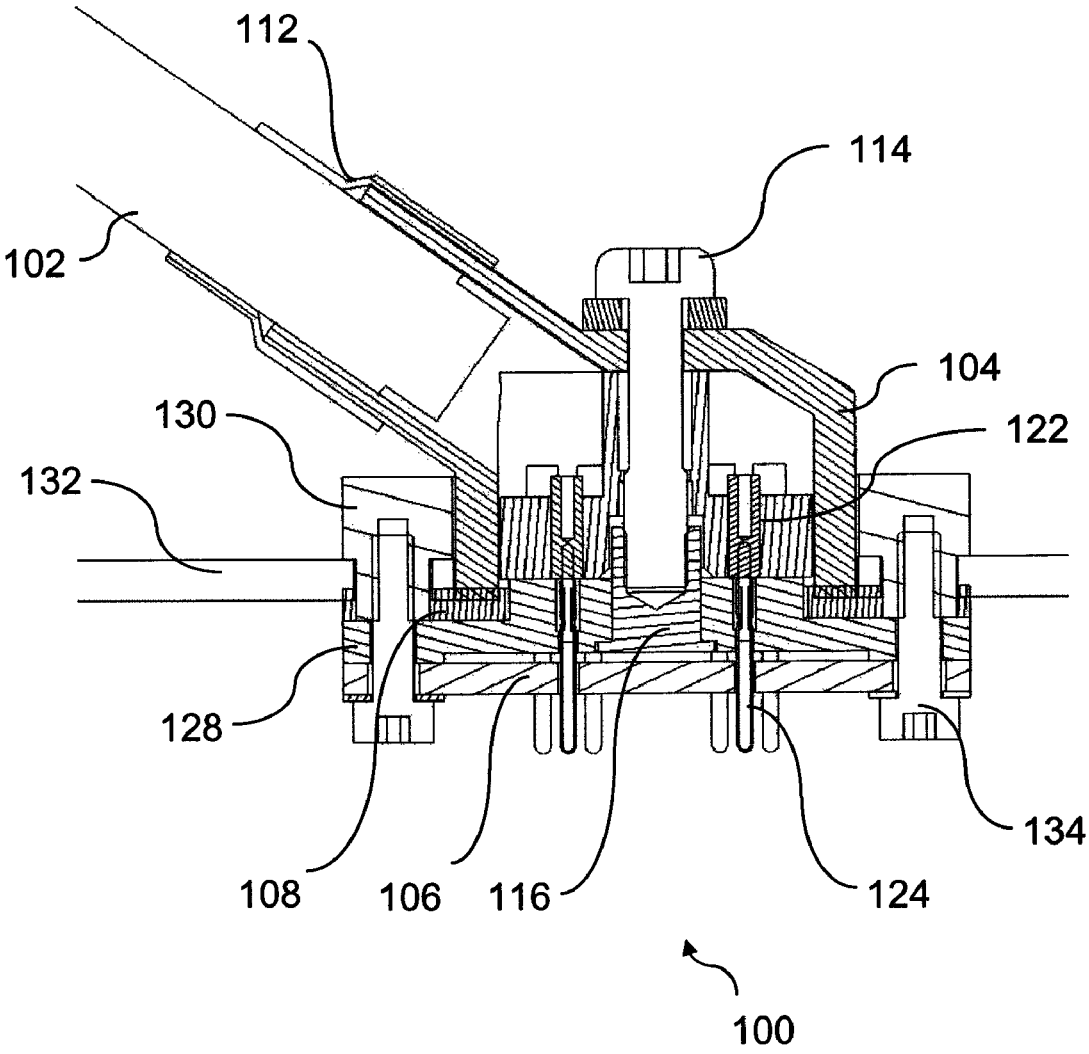
FIG. 1 is a sectional view of a first embodiment of a device according to the present invention connected to a cable.
Figure 2:
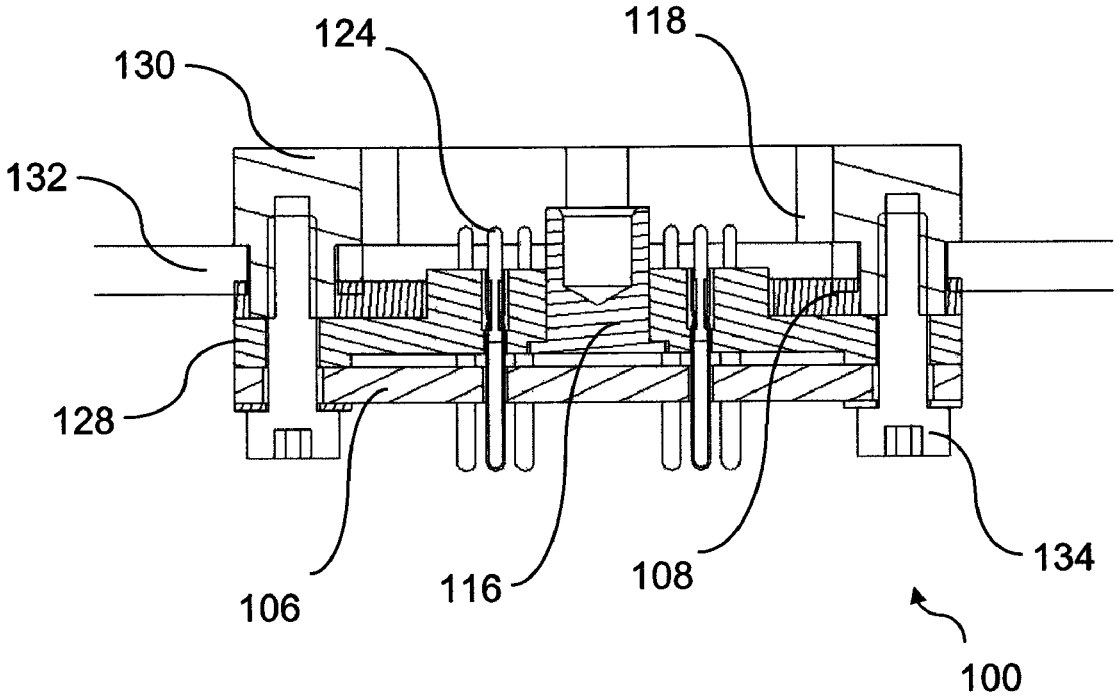
FIG. 2 is a sectional view of the device of FIG. 1 with the cable removed.
Figure 3:
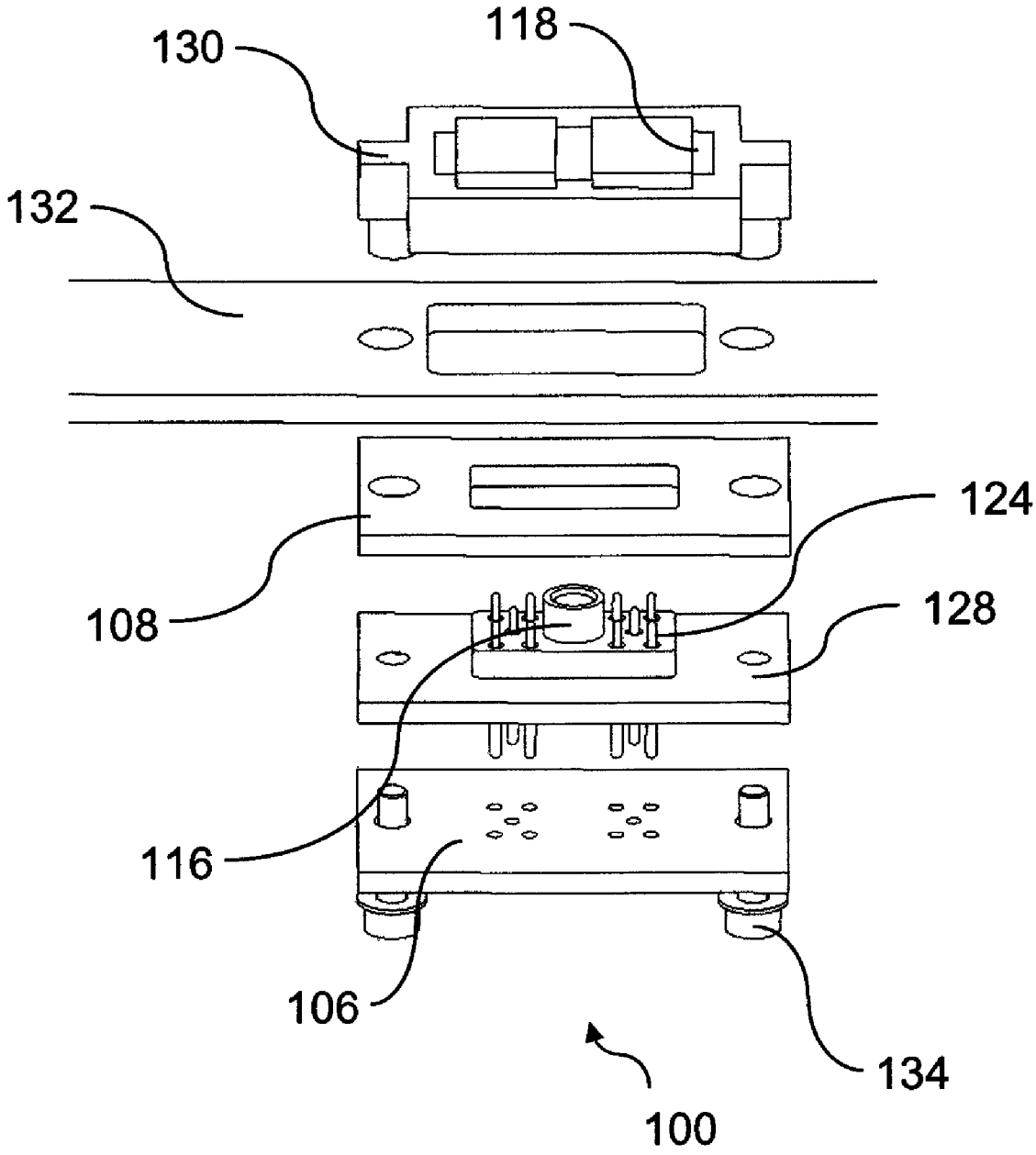
FIG. 3 is an exploded perspective view of the different elements of a device according to the present invention.

The connecting device 100, according to the invention, connects a shielded cable 102 fitted with a conductive shell 104, while also connecting to a case 132 covering a printed circuit board 106. The external sheath of the shielded cable 102 is connected to the conductive shell 104 using a ferrule 112.

The connecting device 100 includes a receiving portion 130, insulated or non-insulated, which is designed to allow passage of the cable 102 and the fitted conductive shell 104 to the printed circuit board 106. In the embodiments, including that shown in the figures, the receiving portion 130 includes a keying mechanism 118 adapted to mechanically prevent incorrect positioning of the conductive shell 104. Preferably, the keying mechanism 118 is located in the periphery of the conductive shell 104, on the internal face of the receiving portion 130.

The connecting device 100 further includes a contact portion 128 having electrical contacts 124. The contact portion 128 is joined with the receiving portion 130 and the printed circuit board 106 through crimping together a conductive joint 108 and a shielding element, which is the case 132 in the embodiment shown. This is performed between the receiving portion 130 and the contact portion 128.

The conductive joint 108 is prepared from, for example, a composition of silicone elastomer filled with conductive particles (graphite, nickel graphite, silver graphite, etc). In particular embodiments, the conductive joint 108 is overmolded on one of the receiving or contact portions 130, 128.

It can be in the embodiment shown that the shielding element is the case 132 itself, when the case 132 is conductive. However, it is also possible, in other embodiments, that the shielding element is a conductive film for a case 132 that is not conductive. For instance, the case 132 may be produced, for example, of molded or machined plastic, having a shielding element, which is a conductive film. Additionally, the receiving portion 130 can be formed with a case 132 according to the invention.

The receiving portion 130 is adapted to allow passage of the cable 102 and fitted conductive shell 104 until the fitted conductive shell 104 is located in abutment with the conductive joint 108.

In order to connect the cable 102, fitted with the conductive shell 104 to the case 132 enclosing the printed circuit board 106, an assembly step of the receiving portion 130 and the contact portion 128, including the electrical contacts 124 and adapted to be joined with the printed circuit board 106, is first performed by crimping together the conductive joint 108 and a shielding element, which is the case 132 in the embodiment shown. This is performed between the receiving and contact portions 130, 128. Subsequently, a step is performed allowing passage of the cable 102 and fitted conductive shell 104 through the receiving portion 130 until the fitted conductive shell 104 is located in abutment with said conductive joint 108.

In the embodiment shown in the figures, the conductive joint 108 forms a seal.

In the embodiment shown in the figures, provision is made for a joining means 134 for joining the receiving and contact portions 130, 128 around the conductive joint 108, on the one hand, and the shielding element, i.e. the case 132, on the other hand.

In the embodiment shown in the figures, provision is made for a joining mechanism 116 with the cable 102 and fitted conductive shell 104, which is adapted to compress said conductive shell 104 onto the conductive joint 108. To this end, the conductive shell 104, which may be conductive, includes a primary screw 114 having a dual function. On the one hand, the primary screw 114 retains the conductive shell 104 in position by being screwed into a nut 116 joined to the device 100. On the other hand, the primary screw 114 causes the conductive shell 104 to bear against the intermediate conductive joint 108.

The figures show six electrical contacts 124 that carry the signals between the cable 102 and the printed circuit board 106. Each of these contacts 124 includes a receiving passageway 122, joined to the conductive shell 104, by way of the insulation, and a terminal joined to the contact portion 128, possibly mounted on a spring (not shown), which, once positioned on the printed circuit board 106, protrudes from the printed circuit board 106 to enable soldering thereof.

In FIG. 1, the wires connecting the contacts 124 to the cable conductors and to the printed circuit conductor tracks have been omitted for more clarity.

The printed circuit board 106 is attached to the contact portion 128.

The printed circuit board 106 and the contact portion 128 are mounted on a case 132, using secondary screws 134 which pinch the wall of the case 132 and the conductive joint 108 between the receiving and contact portions 130, 128 of the connecting device.

In the embodiment shown in the figures, the case 132 is conductive and shields the printed circuit board 106. As the supports on the intermediate conductive joint 108 are provided by the primary screw 114 in relation to the conductive shell 104, and secondary screws 134 in relation to the elements of the case 132, electrical contact is permanently ensured.

As discussed above, in other embodiments, the shielding element may be a conductive film (not shown) for the case 132. It is therefore crimped together, with the conductive joint 108 between the receiving and contact portions 130, 128, respectively, of the connecting device according to the invention. This conductive film is, for example, composed of fabric having conductive fibers (carbonated, nickelated, etc) or a metallized film.

In the embodiments, the receiving portion 130 of the device is integrated, for example, by molding or machining a single piece of plastic material in a case according to the present invention.

The implementation of the present invention improves the shielding performance as the electrical ground path is reduced, thereby also improving the ohmic resistance of this path. Furthermore, this implementation reduces the weight and cost of the connecting device. It simplifies the design by combining the printed circuit and a portion of the case.

The foregoing illustrates some of the possibilities for practicing the invention. Many other embodiments are possible within the scope and spirit of the invention. It is, therefore, intended that the foregoing description be regarded as illustrative rather than limiting, and that the scope of the invention is given by the appended claims together with their full range of equivalents.

The invention claimed is:

1. A connecting device for connecting a cable fitted with a conductive shell to a case, comprising:

a receiving portion;

a contact portion having electrical contacts, adapted to be joined with the receiving portion and with a printed circuit board; and a conductive joint crimped together with a shielding element between the receiving and contact portions, the receiving portion allowing passage of the conductive shell until it is located in abutment with the conductive joint.

2. The connecting device according to claim 1, wherein the receiving portion includes a keying mechanism.

3. The connecting device according to claim 2, wherein the keying mechanism interacts with the periphery of the conductive shell.

4. The connecting device according to claim 1, further comprising a joining mechanism for joining the receiving and contact portions around the conductive joint, and the shielding element.

5. The connecting device according to claim 3, further comprising a secondary joining mechanism for joining the receiving and contact portions around the conductive joint and the shielding element.

6. The connecting device according to claim 1, wherein the conductive joint further forms a seal.

7. The connecting device according to claim 5, wherein the conductive joint further forms a seal.

8. The connecting device according to claim 1, further comprising a primary joining mechanism with the conductive shell and adapted to compress the conductive shell onto said conductive joint.

9. The connecting device according to claim 5, further comprising a primary joining mechanism with conductive shell and adapted to compress the conductive shell onto said conductive joint.

10. The connecting device of claim 1, wherein the shielding element and the receiving portion are integrally formed.

11. The connecting device according to claim 10, wherein the shielding element and the receiving portion are molded.

* * * * *